United States Patent [19]

Ouchi

[11] 4,063,690

[45] Dec. 20, 1977

[54] LINE WINDING APPARATUS

[76] Inventor: Takaaki Ouchi, No. 16-7, Kitamagome 2-chome, Ohta, Tokyo, Japan

[21] Appl. No.: 739,083

[22] Filed: Nov. 5, 1976

[30] Foreign Application Priority Data

Feb. 27, 1976 Japan ..... 51-21856[U]

[51] Int. Cl.[2] ..... B65H 75/34; B66D 1/00

[52] U.S. Cl. ..... 242/54 R; 64/30 D; 74/206

[58] Field of Search ..... 242/54 R, 55, 207, 46.6, 242/46.4; 254/186 R, 187.1, 172, 175.7, 175.5; 64/27 R, 30 R, 30 D, 30 E, 11 R, 13; 74/206, 798

[56] References Cited

U.S. PATENT DOCUMENTS 2,506,397 5/1950 Symonds ..... 254/187.1 X 3,146,612 9/1964 Lorenz ..... 64/30 X 3,509,974 5/1970 Kampert et al. ..... 64/27 X

FOREIGN PATENT DOCUMENTS 2,353,475 10/1974 Germany ..... 64/30 D

*Primary Examiner*—George F. Mautz

*Attorney, Agent, or Firm*—Watts, Hoffmann, Fisher & Heinke Co.

[57] ABSTRACT

An apparatus for winding lines, wherein a winding drum is fixed on one end of a rotary shaft while a disc made of an elastic material is fixed on the other end of said shaft, a supporting member is disposed confronting said disc at a fixed distance, a driving member to rotate the center shaft of said supporting member is installed, and rollers which are rotatably installed on said supporting member are in pressure contact with the circumference of the disc.

2 Claims, 3 Drawing Figures

LINE WINDING APPARATUS

BACKGROUND OF THE INVENTION

The present invention relates to an apparatus for winding lines, particularly cable, hose and the like.

The conventional winding apparatuses of this kind as devised to rotate a winding drum in a direction by means of a driving member at the time of winding a line have been defective in that, each time the direction of rotation of the winding drum is to be reversed for the purpose of rewinding the thus wound line, it must be carried out upon stopping the driving member, and therefore the rewinding work used to take much trouble.

SUMMARY OF THE INVENTION

Principal object of the present invention is to provide an apparatus for winding lines, which eliminates the above discussed defects of the conventional winding apparatuses, and can perform the rewinding of the wound lines while holding the driving member in motion and save trouble in rewinding work.

Another object of the present invention is to provide an apparatus for winding lines, which is devised such that, a winding drum is fixed on one end of a rotary shaft while a disc made of an elastic material is fixed on the other end of said shaft, a supporting member to be rotated by means of a driving member is disposed confronting said disc at a fixed distance, rollers which are rotatably installed on said supporting member are in pressure contact with the circumference of the disc, with the rotation of the supporting member by means of the driving member, turning effort is imparted to the disc by the frictional resistance of the rollers installed on the supporting member to the disc thereby to rotate it synchronously and wind the line, and by imparting a force greater than said turning effort to the line while keeping this state intact, the wound line can be rewound without stopping the motion of the driving member.

A further object of the present invention is to provide an apparatus for winding lines, wherein the rollers installed on the supporting member consist of plural rollers disposed at regular intervals, the turning effort of the respective rollers is practically uniform so that no biased turning effort is imparted to the disc and smooth rotation of the disc can be realized, and on the occasion of the winding work, the direction of rotation of the disc and the supporting member changes causing displacement of the point of pressure contact between the disc and the roller and accordingly abrasion of merely specific portions of the disc can be avoided.

DETAILED DESCRIPTION OF THE INVENTION

Figure 1:
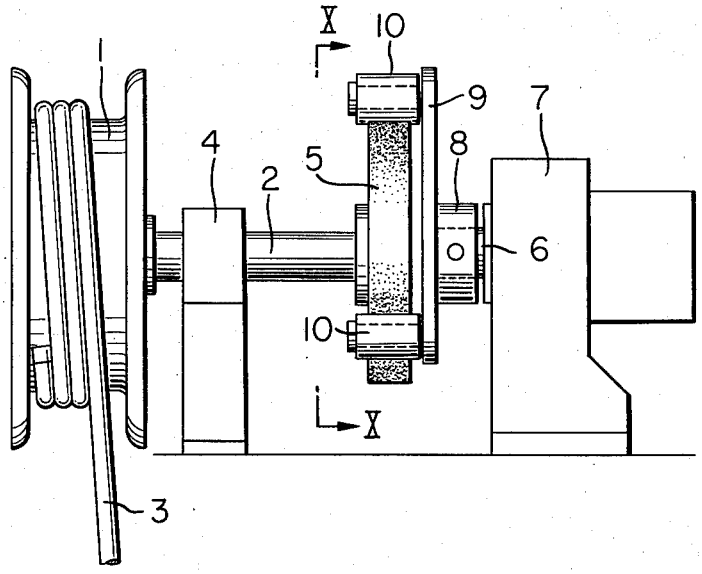
FIG. 1 is a front view of an apparatus for winding lines according to the present invention.

Referring to FIG. 1, the reference numeral 1 denotes a winding drum. This winding drum 1 fixed on one end of the center shaft 2 which is rotatably supported on a bracket 4, and on the other end of said shaft 2 is fixed a disc 5 consisting of semi-hard rubber or the like. A trifurcate supporting member having supporting arms 3 is disposed confronting said disc 5 at a fixed distance, and the center boss 8 of said trifurcate supporting member is fixed on the shaft 6 of a motor 7. Near the fore end of every supporting arm 9 is rotatably installed a roller 10, and three rollers in all provided on the supporting arms 9 are arranged at equal intervals and pressed against the curcumference of the disc 5 so as to have a strong hold on it.

Figure 2:
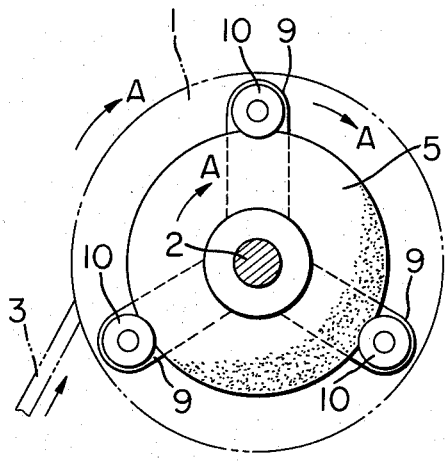
FIG. 2 is a sectional view taken along the line X-X in FIG. 1, which is illustrative of the condition of the operation of the same apparatus as in FIG. 1 at the time of winding work.
Figure 3:
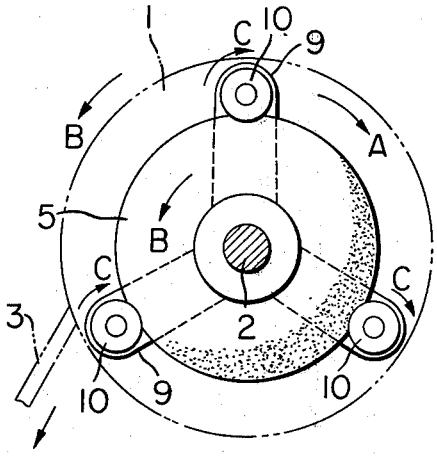
FIG. 3 is the same sectional view as in FIG. 2, which is illustrative of the condition of the operation of the same appratus as above at the time of rewinding work.

In order to wind a line by the use of the foregoing apparatus, the tip of the line 3 is first fixed on a specified spot on the drum 1 like in the conventional apparatuses of this kind, and then the supporting arms 9 are rotated in the direction of arrow A as illustrated in FIG. 2 by means of the motor 7. With the rotation of the supporting arms 9, due to the frictional abrasion between the rollers 10 installed on said arms 9 and the disc 5, the disc 5 and the coaxially fixed drum 1 also rotate in the direction of arrow A, whereby the line 3 is wound round the drum 1.

In the case of rewinding the line 3 in such a state, when a force greater than the turning effort imparted by the rollers 10 is imparted to the line 3, despite the supporting arms 9 keep rotating in the direction of arrow A as above, owing to a force working on the drum 1 in a direction opposite to the turning effort working on the line 3, the drum 1 and the disc 15 rotate in the direction of arrow B opposite to the direction of arrow A, and in the meantime, the rollers 10 turn in the direction of arrow A while turning on its own axis in the direction of arrow C.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. Apparatus for applying torque to a winding drum, comprising: a rotary winding drum; a driven member axially displaced from and rotatably fixed relative to the drum, said driven member having a circular surface portion; a rotary driving member supported for rotation independently of said drum and driven member and rotatable about an axis coaxial with said driven member; and rollers carried by said driving member at fixed locations on the driving member and rotatable about individual axes, said fixed loactions being radially outward of the axis of rotation of the driving member and each roller being firmly pressed into engagement against said circular surface portion of the driven member, at least one of the engaging surfaces of the driven member and the rollers being of an elastic material.

2. An apparatus for applying torque according to claim 1, wherein the driven member has a peripheral surface of elastic material and the drivin member carries a plurality of rollers spaced about said peripheral surface at equal intervals, and the axes of the rollers are parallel to the axis of rotation of the driving and driven members.

* * * * *